US005601434A

United States Patent [19]

Winters

[11] Patent Number: 5,601,434

[45] Date of Patent: Feb. 11, 1997

[54] METHOD AND APPARATUS FOR TEACHING SKIING TECHNIQUES

[76] Inventor: Steven N. Winters, 2605 Commonwealth Ave., Salt Lake City, Utah 84109

[21] Appl. No.: 614,807

[22] Filed: Mar. 7, 1996

Related U.S. Application Data

[63] Continuation-in-part of Ser. No. 401,627, Mar. 9, 1995, abandoned.

[51] Int. Cl.[6] ..... A63B 69/18

[52] U.S. Cl. ..... 434/253

[58] Field of Search ..... 434/253, 247; 482/71; 472/90, 91

[56] References Cited

U.S. PATENT DOCUMENTS

| | | | |
|---|---|---|---|
| 730,956 | 6/1903 | Needham | 472/90 X |
| 3,222,064 | 12/1965 | Langton . | |
| 3,408,067 | 10/1968 | Armstrong | 472/91 X |
| 3,556,521 | 1/1971 | Segal | 472/90 |
| 3,780,663 | 12/1973 | Pettit . | |
| 3,861,318 | 1/1975 | Massa . | |
| 4,410,175 | 10/1983 | Shamp . | |
| 4,545,575 | 10/1985 | Forjot . | |
| 5,413,545 | 5/1995 | Bermann | 482/71 |

FOREIGN PATENT DOCUMENTS

| | | | |
|---|---|---|---|
| 628771 | 10/1929 | France . | |
| 594834 | 1/1933 | France . | |
| 469464 | 12/1928 | Germany . | |
| 2659136 | 12/1976 | Germany . | |
| 997699 | 2/1983 | U.S.S.R. | 482/71 |
| 1493272 | 7/1989 | U.S.S.R. | 482/71 |
| 1680239 | 9/1991 | U.S.S.R. | 482/71 |

*Primary Examiner*—Cary E. O'Connor
*Assistant Examiner*—Jeffrey A. Smith
*Attorney, Agent, or Firm*—Workman, Nydegger & Seeley

[57] ABSTRACT

A device which can be manufactured in multiple embodiments which makes it possible to break down and practice separately the steps involved in various ski techniques that require sliding the skis sideways into the snow as is required for a hockey stop, christies, and other common skiing manuevers. One embodiment of the invention contains a suspended overhead beam and a harness for holding the skier that is pivotally and slidably engaged with the overhead beam. This guides the direction of the skier while traversing the slope.

To effectively learn skiing techniques requiring the sideways sliding of the skis such as the hockey stop, a skier is suspended in the air and makes first contact with the ski surface in sliding postion. In this manner, the skier learns the feel of the slide, one of the ending steps, prior to earlier steps. By breaking down the skill and learning the last steps first, learning and confidence is facilitated.

28 Claims, 13 Drawing Sheets

METHOD AND APPARATUS FOR TEACHING SKIING TECHNIQUES

Related Application

This application is a continuation-in-part of application Ser. No. 08/401,627, filed on Mar. 9, 1995 abandoned.

BACKGROUND OF THE INVENTION

1. The Field of the Invention

The present invention relates to assemblies and apparatus that aid in teaching confidence and skills which are required to ski at levels and particularly at an intermediate or advanced level.

2. The Relevant Technology

Historically, skiing skills, including but not limited to the hockey stop, slide slip, skid, christy turn, parallel turn, aerial turn, and mogul top turn, have been taught on the ski slopes. These techniques are taught after the skier has advanced beyond traditionally accepted beginner techniques like the gliding wedge and snowplow stop. If techniques like the hockey stop, parallel turn and slide slip could effectively be taught first then the old method of relying on the wedge and snowplow to initiate new skiers hopefully would be discarded.

Most ski schools teach the wedge and snowplow first because they are easy to learn, they effectively control the skier's speed on gentle beginner slopes, and almost everyone can do it after a few attempts. However, at higher speed and on steeper slopes where the majority of recreational and competition skiing occurs, these methods do not allow for quick stops and maneuvering.

Another problem with teaching the wedge and snowplow to beginning skiers is that these techniques become a crutch which the skiers come to trust and rely on at the expense of moving to more advanced and practical ski techniques. By first teaching skiers more advanced techniques in a controlled and safe environment, the skier is able to more quickly advance beyond the beginning level and enjoy the sport.

When new skiers stand at the top of even mildly sloping hills, their initial and primary concerns are to (1) avoid injury, and (2) to be able to stop whenever they want to or need to stop.

Because more advanced stopping and turning techniques generally require much more complex balance and motion skills, ski instructors almost always resort to first teaching the wedge and snowplow in order to gradually introduce new skiers to the sport. This can actually be a negative learning experience because the skier gets in the bad habit of using the inside edge of the uphill ski in order to do the wedge or snowplow maneuver. This habit becomes very ingrained if the skier uses it for several days and becomes a major stumbling block when trying to learn more advanced techniques like the hockey stop or parallel turn. If the inside edge of the uphill ski is used or inadvertently catches the snow during a hockey stop or parallel turn, the skier will almost always be thrown off balance.

Skiing is one of the only sports in which the methods that are first taught are not actually required fundamentals of the sport. For example, in basketball some of the fundamentals are dribbling, passing and shooting and in football they are passing, blocking and tackling. When people learn how to play basketball or football they are generally taught these fundamentals on the first day.

When people go to professional basketball games they see players dribbling, passing and shooting and at football games they see passing, blocking and tackling because these are true fundamentals of the respective sports. On the other hand, a professional skier does not normally perform a wedge or a snowplow operation. The only time anyone ever sees a wedge or snowplow operation is when someone is an inexperienced skier or has maintained this bad habit, often to the detriment of learning more advanced skills. Therefore, the wedge and snowplow techniques should be considered teaching methods and not necessary fundamentals of the sport.

The wedge and snowplow are desirable teaching methods because they can be taught in a stationary position on level terrain and only involve the simple action of putting the ski tips together, pushing the ankles apart, and bringing the knees together. After this awkward position is learned, the skier maintains it for slowing velocity.

Turning is accomplished by simple shifting weight from one ski to the other ski. In the wedge position, turning is a simple one step process of shifting weight, and stopping is a simple one step process of pushing the ankles further apart thus making the inside edge of both skis bite harder into snow. The wedge and snowplow can be effectively used at an extremely slow speed; a particular advantage for teaching skiing since most beginners want to ski slowly as they become acclimated to the sport.

The more effective advanced techniques like the hockey stop do not work at extremely slow speeds. To effectively turn or slip one's skis from a position parallel to the direction of travel to a position perpendicular to the direction of travel, the skier has to have a higher velocity than is desirable to most beginning skiers who often feel uncomfortable with even moderate speed or lack confidence to maintain such speed. Also, maneuvering with the hockey stop and other skills and techniques requiring sliding the skis sideways involves a much more complicated multi-step shifting of balance and force than the single step process involved in turning or stopping with the wedge.

Because of the effectiveness and greater control exhibited by the advanced skiing techniques such as the hockey stop, it is desirable to get skiers to this level as soon as possible. Furthermore, it would be desirable to reduce or eliminate the amount of time spent teaching the teaching methods of the wedge and snowplow because of their inherent drawbacks.

Harnesses attached to overhead track have been used to maintain body balance as seen in U.S. Pat. No. 2,478,004 to Newell, Aug. 20, 1945 and to assist ambulatory patients as seen in U.S. Pat. No. 3,780,663 to Pettit, Dec. 25, 1973. The overhead track concept as been used for acrobatic training in figure skating as seen in U.S. Pat. No. 4,410,175 to Shamp, Oct. 18, 1983.

Harness devices have also been used in skiing. U.S. Pat. No. 3,861,318 to Massa, Jan. 21, 1975 includes a harness which is attached to a cable system suspended above a ski run. Furthermore, the system has a braking mechanism at the end of the run which stops the skier.

The major advantage of the Massa invention as stated by the inventor is that an untrained skier is protected from injury and can ski with ease of mind. However that ease of mind only lasts as long as the skier is in the harness and attached to the cable. As soon as he tries the similar run with no automatic braking system at the end, the skier has no ease of mind. The ability to attain high speeds in a secure environment does not produce lasting ease of mind. Permanent ease of mind is obtained with a learned ability to quickly stop at higher speeds without any external assistance. The quickest method of stopping is the hockey stop and once this technique is acquired other intermediate and advanced techniques can quickly be learned with vastly increased confidence.

U.S. Pat. No. 4,545,575 to Forjot, Oct. 8, 1985 includes a harness which is suspended from an overhead rail system. The device includes a braking mechanism which is activated when the skier falls. The skier moves around under the overhead rails from which the harness is suspended. However, the harness cannot support any of the skier's weight as new skills are learned because as soon as any weight is applied to the harness the brake is activated.

One disadvantage of the Forjot device is that it does not allow partial suspension of a skier's weight. It would be advantageous to have a harness partially support the skier throughout a new maneuver so that loss of balance does not result in total loss of control. For example, if a skier is trying to learn a hockey stop and if the maneuver is allowed to continue even after a partial loss of balance, subsequent attempts could be adjusted until balance is maintained on the skis without any dependance on the harness.

SUMMARY AND OBJECTS OF THE INVENTION

It is an object of this invention to provide a safe and rapid method of teaching more advanced ski techniques to beginning skiers, or skiers who are not progressively adding to their repertoire of techniques.

These and other objects and features of the present invention will become more fully apparent from the following description and appended claims, or may be learned by the practice of the invention as set forth hereinafter.

The various embodiments of ski skills training device as part of this invention allows the skier to practice the steps of a hockey stop separately before they are combined. The result of a correctly executed hockey stop is that the skier is stopped and is standing perpendicular (i.e. the ski edges running the length of the ski perpendicular with the slope rather than downward) to the direction of downward travel and the skis are parallel to one another. Various embodiments of a ski skills training device according to the present invention allow the skier to experience the end result of the hockey stop process without having to go through the actual each and every step to get there. When the starting and the ending of hockey stop are successfully merged on the ski skills training device, the skier acquires a tremendous boost in confidence. He realizes he can stop whenever he wants by using the most effective method, the hockey stop.

The skier can use all of various embodiments of the ski skills training device to learn and practice different ski skills. The invention is particularly useful for teaching techniques that require the skier to slide the skis sideways into the snow. To perform a correct side slip, a skier has to be on a fairly steep slope. The necessary slope is generally steeper than is comfortable for most beginners to venture, The basic structure of ski skills training device is a track or other means of support to which the skier is connected. By being connected to a firm support; the skier may stumble or lose balance without falling altogether. Furthermore, the skier may be placed directly into a desired position that otherwise would not be possible without a fair amount of experience. In this manner, the actual steps of a particular skiing technique can be taught in reverse order to assist the beginning skier.

An example of a ski technique requiring the sideways sliding of the skis is the hockey stop. The individual steps that make up a hockey stop are as follows:

1. Obtain a sufficient speed.
2. Lessen weighing of skis with a slight hopping up motion or slightly slip weighting to the edge which will become the inside edge of downhill ski and begin skidding.
3. Pivot the skis around toward a position perpendicular to the direction of travel while avoiding under rotating or over rotating.
4. When this perpendicular position is reached, increasingly lean away from the direction of travel to increase pressure to the inside edge of the downhill ski.
5. Apply some pressure to the outside edge of uphill ski for balance and additional stopping power.
6. During deceleration reduce leaning so that when the stop is complete the skier's weight is balanced directly above the skis.

Steps 2 and 3 and steps 4 and 5 occur somewhat concurrently but on all embodiments of the present invention they can be taught separately and therefore are listed separately. These steps are further complicated by the fact the skier must avoid catching the inside edge of the uphill ski. When this happens the skier is generally thrown off balance and on to the ground.

One embodiment of the ski skill training device allows the skier to experience the final steps of a hockey stop without going through the prior three steps. After the skier is proficient at the final steps the initial steps are then added. The skier is never overwhelmed by having to learn several steps at once. The skier also has several external means of rotating his body from parallel to perpendicular thereby permitting the skier to practice the transition from the first steps of a hockey stop to the final steps.

Another embodiment better assists in learning the slide slip and skidding more easily because the ski skills training device adjusts to steeper slopes. The skier has a greater sense of control and support because of a hand operated brake to control her speed in addition to the harness which is attached to the overhead beam as found on several embodiments.

Another embodiment of the ski skills training device allows the skier to move freely side-to-side at will, thereby allowing the skier to safely practice parallel and christy turns. Another embodiment or feature that can be implemented in this embodiment has an overhead beam which conforms to a varied snow surface to allow the skier to safely practice mogul top and aerial turns.

An option easily implemented in all embodiments is a slower controlled braking means that allows the skier to push himself to his personal limits during the learning process because he knows he can always control his speed and stop when necessary.

Another embodiment of the ski skills training device does not require a slope for it operation and is portable because of its framed nature. An advantage of this portable embodiment is its ability to help beginning skiers who are afraid of slope when they first try skiing. In this embodiment, a motor or a push or a pull from an instructor provides the required acceleration. Since the unit is portable, it can be placed over a variety of differing ski terrain so that the degree of slope can easily be modified from completely level to a nearly vertical slope.

Another advantage of the portable, framed embodiment is that training time can greatly be reduced because training can occur in both directions. The skier can remain in a perpendicular position and be accelerated to his right. When an appropriate acceleration is reach the motor is disengaged and the skier places his skis on the ground treating the right ski as the downhill ski and coming to a stop. Then he can be immediately accelerated to his left and again place the skis on the ground now treating the left ski as the downhill ski and coming to a stop. Learning therefore occurs in both direction. More people can be trained on the device because less time is required per person and therefore this embodiment can be extremely cost effective.

The primary advantage of all the above described embodiments is that the skier is able to practice exactly the same technique over exactly the same terrain in rapid succession until the skill is mastered! The skier more quickly learns the "feel" of the techniques and gains experience with balance and motor skills necessary to perform the various techniques.

The embodiments of the ski skills training device which allows the skier to ski anywhere under a swept out arc of the overhead beam provides vast training capabilities. The skier is completely unrestricted in this area and can learn and practice christy and parallel turns with the complete confidence and control that the overhead support and braking capability provide.

Although the descriptions above contain many specificities, these should not be construed as limiting the scope of the ski skills training device but as merely providing illustrations of some of the presently preferred embodiments of this invention. For example, the first object of the ski skills training device is to provide the experience of stopping with the skis perpendicular to the direction of travel. This is most effectively accomplished by starting the skier in that perpendicular position, something which has never been done before.

The ski skills training device always has the skier making contact with the snow surface at the same point with the skier determining this contact point. The pulley which raises the skier off the ground for the return to the starting point could lock in a position which suspends the skier above the snow. The skier controls a device which releases this lock and gently lowers him to the ground at the desired contact point. The release could occur at any point along the travel of the overhead beam, therefore, the beam could always be the same distance from the ground with the point of contact be determined by the skier.

Also, the entire system could be computerized so that after each attempt the computer could activate a motor which raises the skier off the ground and returns her to the starting position. The computer could then activate a motor which would orient her in the correct position by turning a pivotry member that holds the harness. The skier then pushes a button which commands the computer to release the roller carriage when she was ready for the next attempt. Safety switches which are held by the skier and the instructor could be programmed to turn off the computer and motors to prevent injury and distress. Using computers could greatly increase the operating speed of the device between successive attempts to further compress training and allow more skiers to be trained during a unit of time.

The harness is not an essential element in the ski skills training device. The skier could suspend himself in a perpendicular position without the harness simply by holding on to rotating harness bar. If the distance between the bar and the ground were constant he could make contact with the snow by letting go of the bar at anytime.

Also, there are multiple methods of applying torque to turn the skier from a position parallel to the direction of travel to a direction perpendicular. Many of the preferred embodiments have been described. Other methods might include but are not limited to the following:

1. A long pole that is held by both the instructor standing to the side of the ski skills training device and the skier as he travels along the overhead beam.
2. Cords attached to the front of the skis which are pulled by the instructor to provide the necessary torque.
3. A electric motor attached to rotating harness bar 11 which will turn the skier when activated.

Also, the ski skills training device does not need to rely on gravity for acceleration. The overhead beam could be level and acceleration could be caused by pulling on a retrieving line or by an opposing line on the other side. Also, the skier could actually be pushed by the instructor to increase acceleration. Any embodiment of the device can be motorized and the control can be computerized. The computerized and motorized device will release the skier on command from the skier or instructor. At the end of the run the device will raise the skier up, return the skier to the starting position and rotate the skier into the predetermined starting orientation.

Since assistance devices have only been known to be used with a skier's skis pointed in the downhill direction, they are entirely ineffective for teaching the skills as explained by the present invention where the skiers first contact with the snowy slope occurs with the skis at all possible angles to the downhill direction, thereby allowing quick and easy training of important skill techniques. The present invention proves to be a great factor in reducing the time required to instruct new skiers in more advanced techniques. Furthermore, it prevents the acquisition of the bad habit of using the wedge and snowplow and can even be used to rehabilitate skiers who have acquired an unhealthy or inhibiting dependency or incorrect teaching methods rather than substantial techniques.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawing depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1A:
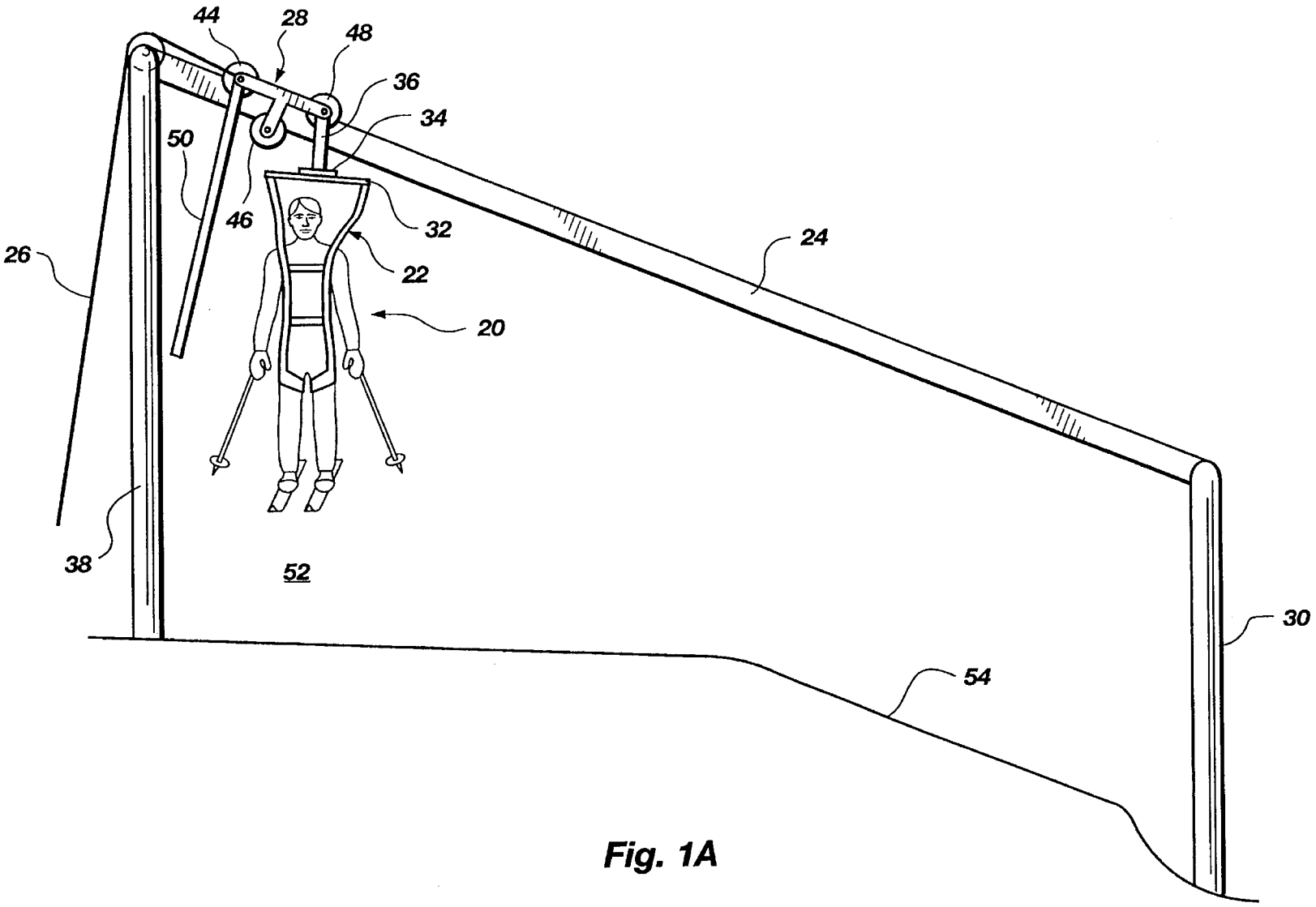
FIG. 1A is a side view of one embodiment of a ski skills training device showing a skier in starting position for learning the last steps of a hockey stop.
Figure 1B:
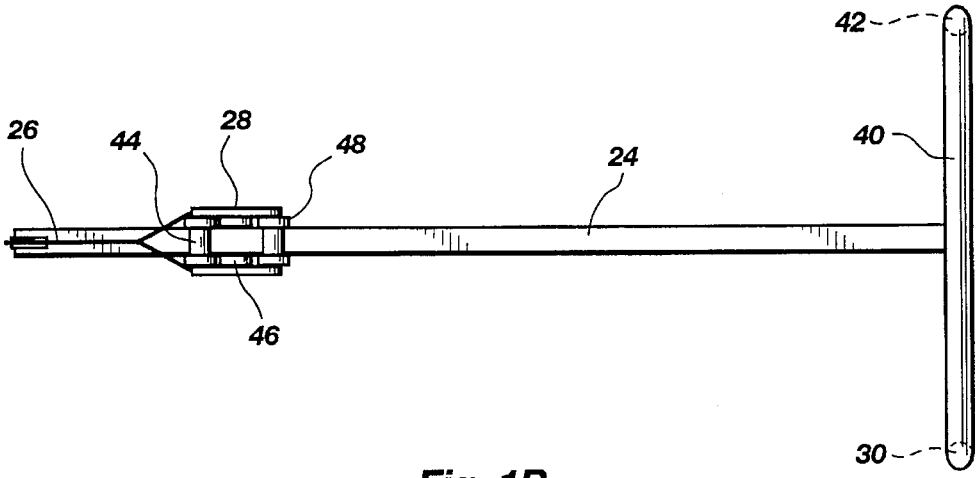
FIG. 1B is a top view of the device shown in FIG. 1A but the harness and skier are not shown.

A typical embodiment of the ski skills training device is illustrated in FIG. 1A (side view) and FIG 1B (top view). The skier 20 is in the starting position in a harness 22 at the top of an overhead beam 24. The skier 20 is held in this initial position by a retrieving line 26. The retrieving line 26 is connected to a roller carriage assembly 28 and is anchored on the other end or attached to a motor for automatic retrieval after the skier 20 has made a run down the length of the snow-covered slope or other ski surface. The retrieving line 26 is initially in a anchored position in order to hold the skier 20 at this initial position. Furthermore, the rate at which the retrieving line is loosened can be controlled for adjusting the overall acceleration of the skier 20 and for stopping the skier 20 before hitting bottom support beam 30.

According to this embodiment, an overhead beam 24 is suspended by a upper support beam 38 and a bottom overhead beam 40 that is held up by bottom support beams 42 and 30 respectively. The roller carriage 28 has a series of rollers 44, 46, and 48.

The overhead beam 24 may be of varying dimensions and cross-sectional structures as long as the roller carriage 28 is able to easily roll thereon to therefore be in harmony with the present invention. Furthermore, other embodiments may use a tensioned cable or other structure as the functional equivalent of the overhead beam 24. In the illustrated embodiment, the beam is square but it may also be of I-beam formation or round.

Note also in FIG. 1A the torsion grip 50 is connected to the roller carriage 28. This torsion grip 50 is used by the skier 20 to rotate or pivot her position with respect to the slope for ski surface below. By thus using the torsion grip 50, the skier may properly orient the skis to learn a particular skiing technique according to direction by an instructor.

Figure 1C:
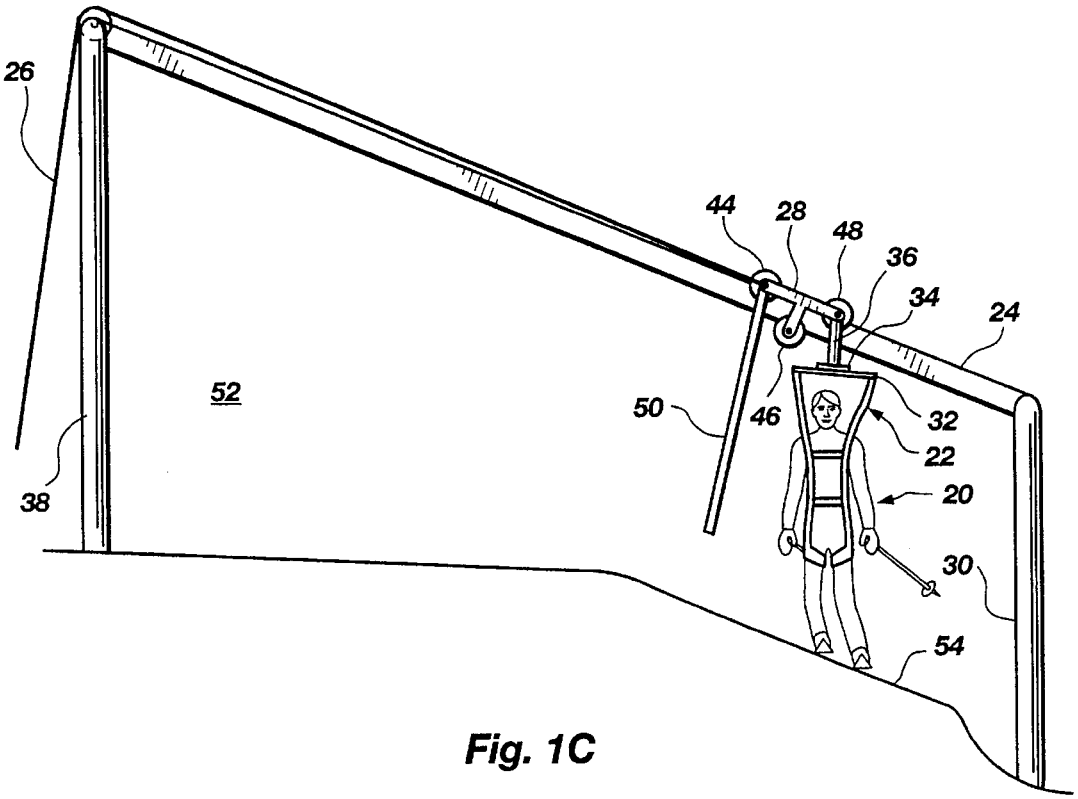
FIG. 1C is a side view of the embodiments of FIG. 1A showing a skier after having completed the final steps of a hockey stop.

In the starting position the skier is over a suspension area 52. As the roller carriage 28 moves down overhead beam 24 the skis are brought into contact with the snow at a ski engagement surface 54 as shown in FIG. 1C. If the skier fails to stop on the ski engagement surface 54, he is again suspend at the end over a bottom safety ditch.

FIG. 1A, 1C, 1D, and 1E demonstrate the operation of this embodiment of a ski skills training device according to the present invention. Referring first to FIG. 1A, the skier 20 is placed in harness 22 that is in turn attached to the roller carriage 28 riding on overhead beam 24. The skier is first pulled by the retrieving line 26 to the starting point at the top of overhead beam 24 as shown in FIG. 1A. At this point, the skier 20 is completely suspended in the air above the ground and ski surface. From this position, the skier is ready to be introduced into the final steps of a hockey stop without going through the first steps according to the steps defined previously. Note that the skier is in a position such that the skis are oriented to slide sideways against the skiing engagement surface 540

From the initial position in FIG. 1A, the retrieval line 26 is released so that the skier 20 gains momentum while the roller carriage 28 travels down the overhead beam 24. As explained previously, this speed may be regulated if necessary. Finally, the skier 20 will travel to a point where the skier 20 no longer is suspended in the suspension area 52 and then the skis may slide sideways along the engagement surface 54 as shown in FIG. 1C. At the point of engagement, the skier is travelling at a sufficient speed to correctly execute the last steps of the hockey stop and engage the edges of the skis until she comes to a complete stop.

As soon as the skier has stopped he is coached in any errors he might have made. Because repetition is required for the mastery of any physical skill, the skier is immediately pulled by retrieving line 26 to the starting position again and released. The process is repeated numerous times and the speed of the skier 20 may be increased as his confidence builds.

If the skier is not placing most of his weight on the inside edge of the downhill ski, the uphill ski is removed thus forcing him to place all his weight on the downhill ski. Even if he seems to be distributing his weight correctly this is probably a good exercise.

As soon as the skier has acquired a confident perpendicular stop going full speed, she has made a significant mental discovery or mental leap. She now knows that even at higher speeds, if she can get her skis perpendicular to the direction of travel, she can maintain her balance and engage the appropriate edges on her skis to rapidly come to a complete standing stop.

Figure 1D:
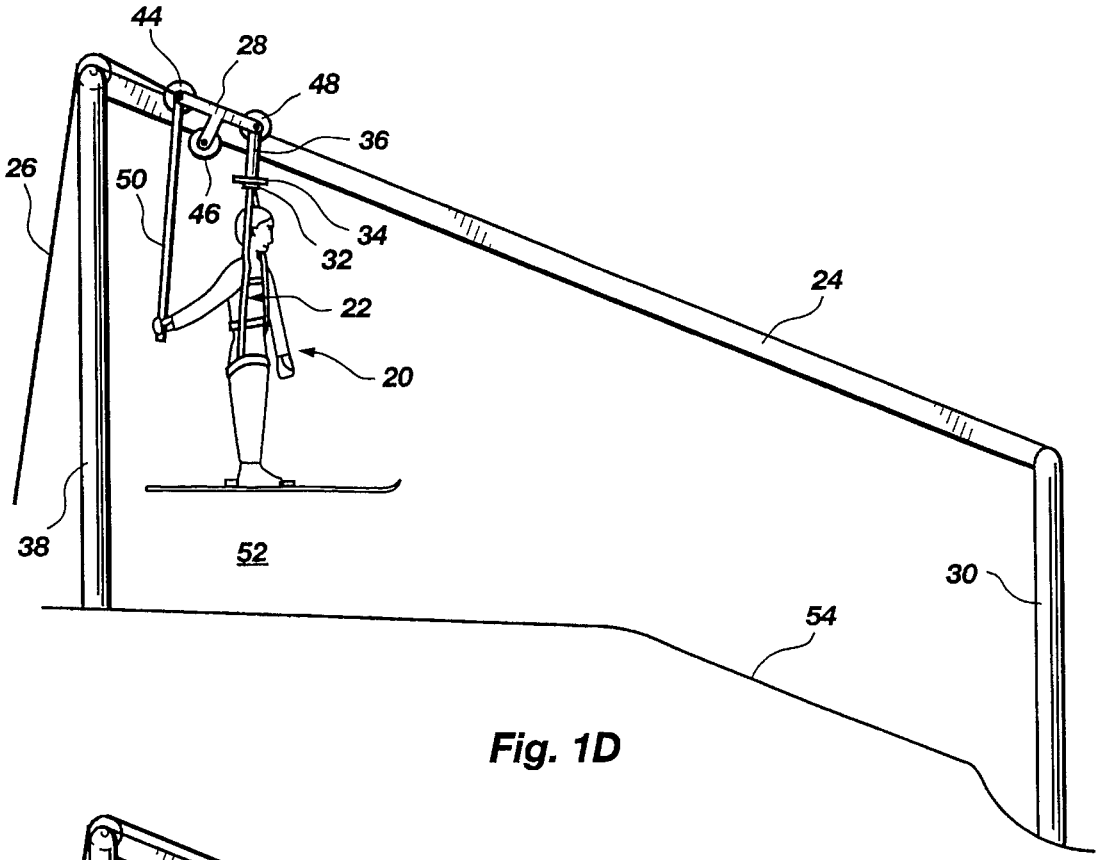
FIG. 1D is a side view of the embodiments of FIG. 1A showing a skier in a starting position from which all steps of a hockey stop will be attempted with the assistance of a torsion grip.
Figure 1E:
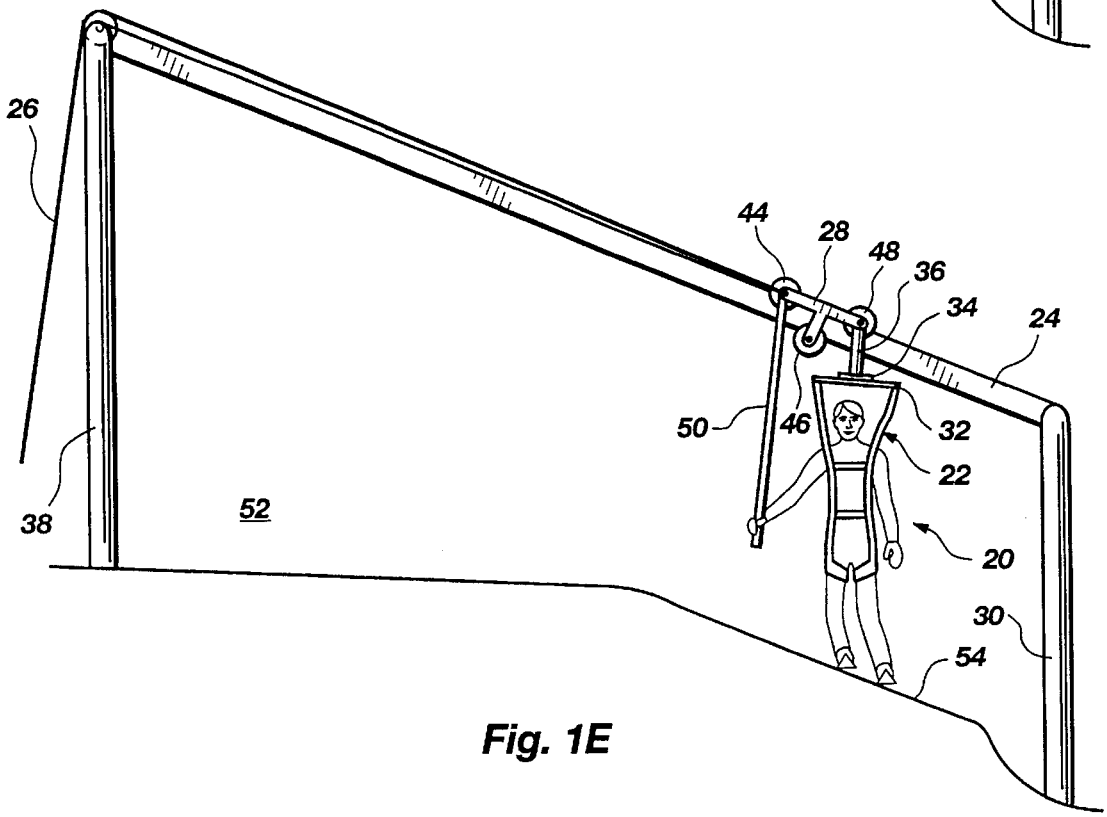
FIG. 1E is a side view of the embodiments of FIG. 1A showing a skier having completed a hockey stop with the assistance of a torsion grip.

With this knowledge the skier can now be trained in making the transition from a moving parallel position to the perpendicular stopping position thereby encompass all of the steps required for a successful hockey stop. The skier is returned to the starting point with his skis positioned parallel (i.e. skis oriented down, used by respect to the slope) to the position of travel as shown in FIG. 1D. Note that the skier is holding torsion grip 50 in preparation of pivoting from the parallel to the perpendicular position. When his skis make contact with the snow he will pivot using torsion grip 52 or by slightly hopping up on both skis and rotating them or by using a step christie. If he fails to turn himself perpendicular before reaching the end of beam 13 the ski skills training device gently brings him to a stop with a spring means attached to the retrieving line 26 (not shown). The skier is coached and then immediately pulled back to the starting point. Because of the ease and speed at which repetition can occur, learning occurs very rapidly.

If after the skier masters the technique of pivoting his skis perpendicular but then cannot seem to engage the ski edges correctly, he is immediately taken to the starting point again, turned perpendicular and started from this position over and over until he can again perform the last three steps of the hockey stop. After he has again acquired these skills, he is again started in a parallel position until the turn to perpendicular is correct and the beginning steps are fluidly merged with the final steps of the hockey stop.

Most skiers have a side that it is easier to turn towards. The training should probably start with the side that it is easiest to turn towards. If the skier began by learning a left hockey stop it is now time to repeat the same process to learn a hockey stop to the right. The skier is returned to the starting point on the beam and again positioned perpendicular but with his skis pointing in the opposite direction and the process begins again. Essentially the process of learning the hockey stop is reversed engineered by beginning with the result, a perpendicular stop and working backwards to the initiation, a higher speed parallel approach.

Figure 1F:
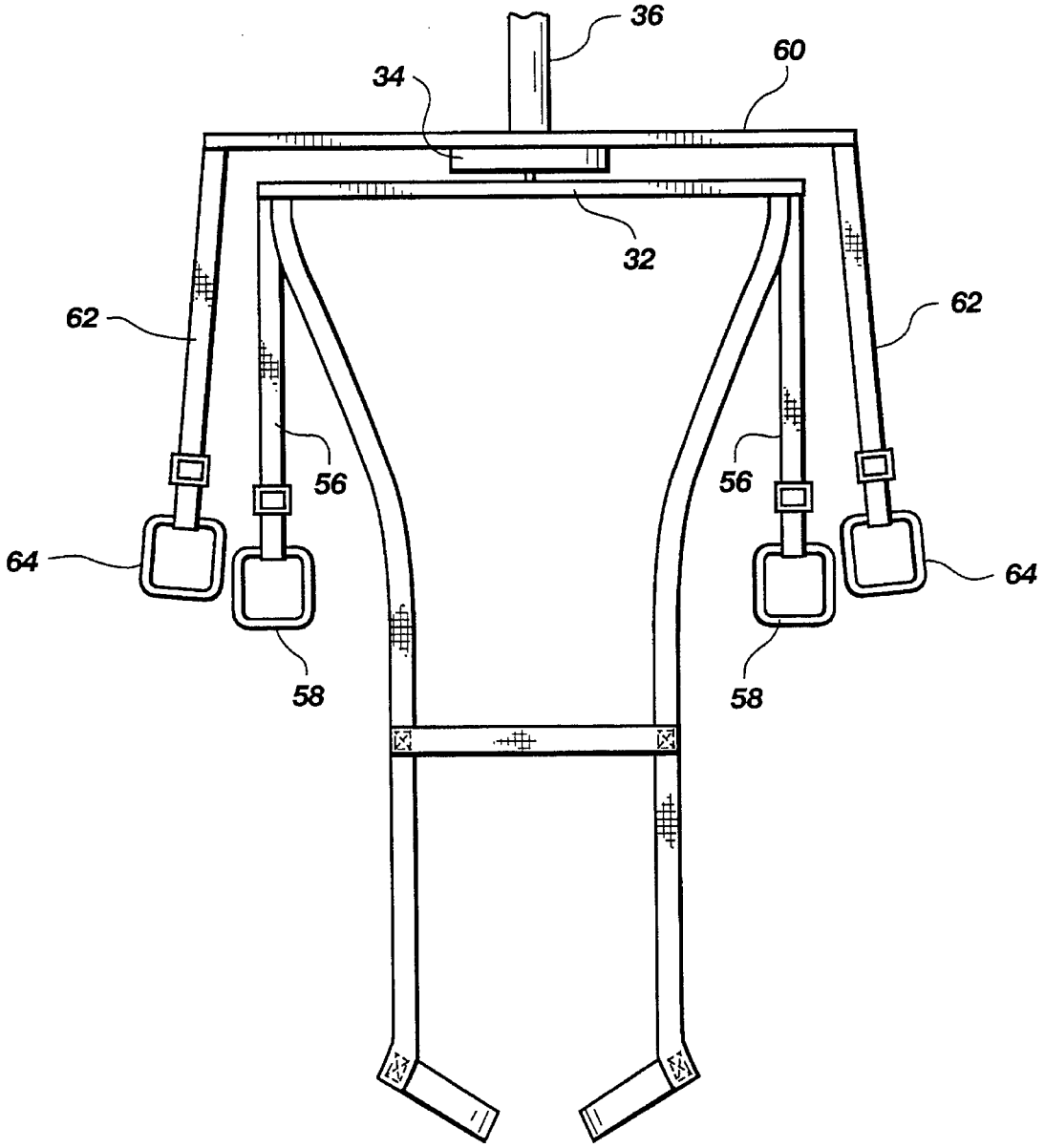
FIG. 1F is a front view of an advanced harness with unweighting and torsion straps and grips.

An advanced harness configuration is shown in FIG. 1F that an be used with any embodiment. Unweighting straps 56 and unweighting hand grips 58 are connect to rotating harness bar 32. An unweighting and torsion bar 60 is attached to roller carriage 28 by connector 36 such that it can be rotated and locked into any orientation. Unweighting and torsion straps 62 and unweighting and torsion hand grips 64 are connected to unweighting and torsion bar 64.

A skier strapped into the advanced harness configuration as shown in FIG. 1F, can use either the unweighting hand grips 58 or the unweighting and torsion hand grips 64 in order to assist in pivoting herself for orienting the skis properly to learn a new technique. The unweighting hand grips 58 allows the skier to take the weight off the skis to make pivoting easier, while the unweighting and torsion hand grip 64 allow the skier to remove weight as well as add pivoting ability from the upper body to facilitate the pivoting process.

Figure 1G:
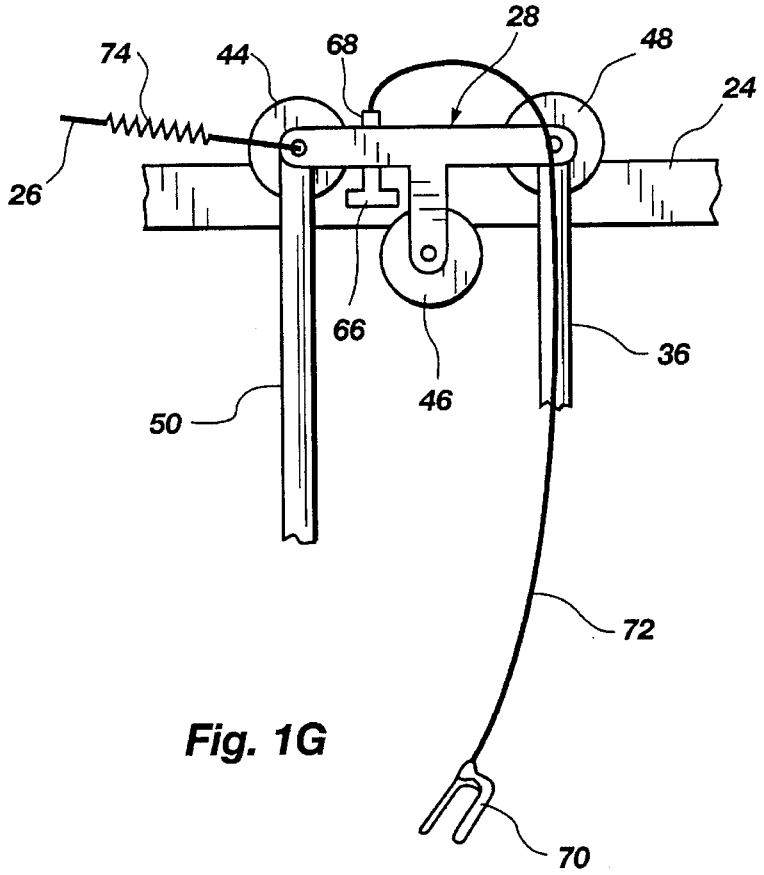
FIG. 1G is a side view of the roller carriage of FIG. 1A with a braking mechanism which can either be activated by the skier or instructor.

A braking mechanism is shown in FIG. 1G that can be used in conjunction with the roller carriage 28 of the embodiment FIG. 1A–1G. A brake shoe 66 is positioned so that when deployed it moves inwardly to engage the side of overhead beam 24. Brake shoe is attached to a braking mechanism 68 which is mounted on roller carriage 28. Braking mechanism 68 is deployed with a brake hand grip 70 that is connected by a brake cable 72 to braking mechanisms. The hand grip is run internal to the connector 36 and exits at a position near the harness where the skier may easily actuate it. FIG. 1G also shows a retrieving line spring 74 is incorporated in retrieving line 26 to lower the deceleration at the bottom of overhead beam 24. When the retrieving line 26 is extended to its fullest position, retrieving line spring 74 cushions the otherwise abrupt stop that a skier would experience. Furthermore, the retrieving line 26 is so configured that its final length would allow the skier to stop using the retrieving line spring 26 well before coming to the bottom end of overhead beam 24.

Figure 1H:
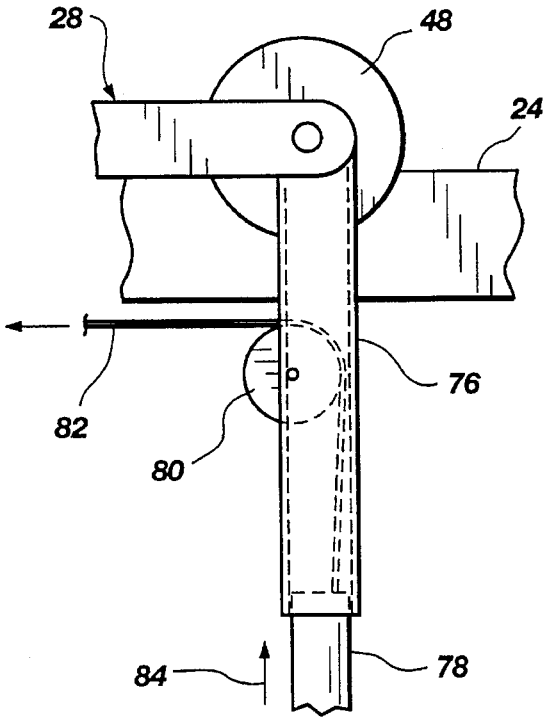
FIG. 1H is a side cutaway view of the roller carriage of FIG. 1A outfitted with lifting cable and showing a method for lifting the skier off the snow surface so that when he is returned to the starting position the skis do not drag along the snow.

A method for raising the skier off the ground to more easily return him to the starting position is shown with accompanying hardware adjustments to the roller carriage 28 of the embodiment shown in FIGS. 1A–1E is shown in FIG. 1H. Connector 36 is replaced with tubular connector 76 that is otherwise connected to roller carriage 28. Interfacing with the tubular connector 76 in tight fit fashion is piston member 78. Connected to the piston member 78 over a pulley 80 is the retrieving line 82. When retrieving line 82 is pulled, the piston member 78 moves upward as indicated by arrow 84 to raise the skier a safe distance above the ground before pulling the roller carriage back to the initial position as shown in FIG. 1A. Retrieving line 82 may be a separate retrieving line or the same retrieving line used to pull the roller carriage.

Figure 1I:
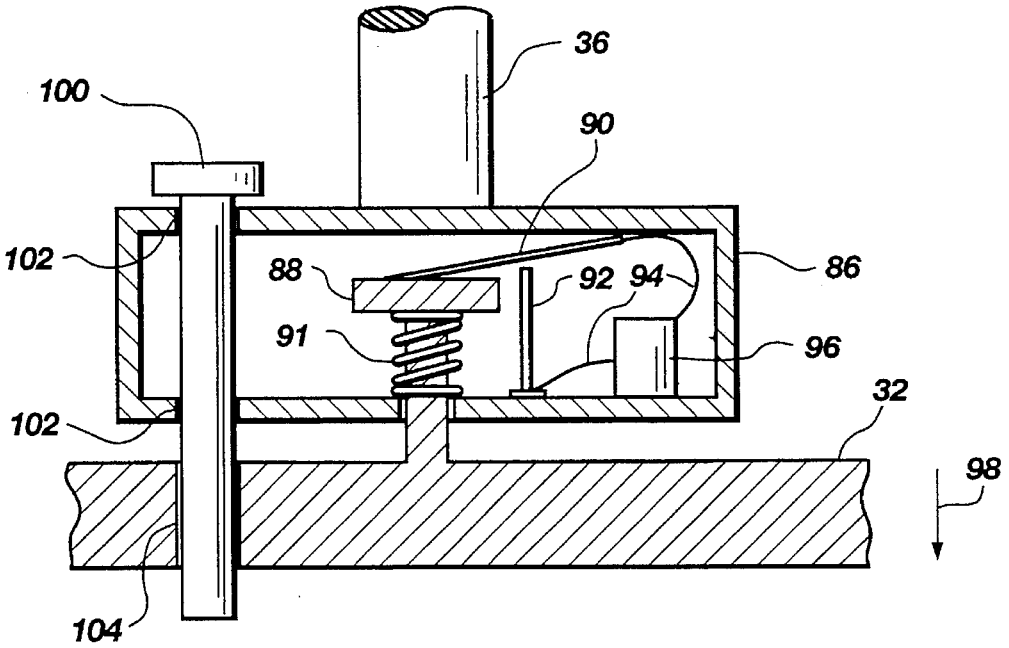
FIG. 1I is a side cutaway view of the roller carriage of FIG. 1A outfitted with a hollow suspension plate containing an alarm system which sounds when the skier puts weight on the harness. Also shown is a method for locking the rotating harness bar in any desired position.

The method for indicating when skier is putting weight on the harness is along with all associated modifications to the embodiment shown in FIGS. 1A–1E is shown in FIG. 1I. Suspension plate 34 in FIG. 1A is replaced with a hollow suspension plate 86. That is in turn coupled with connector 36 to the roller carriage 28. The rotating harness bar 32 has a top bolt 88 that fits within the hollow suspension plate 86. Furthermore, the top bolt 88 is supported by spring 91 in order to keep it raised when no weight is resting upon the harness that is attached to the rotating harness bar 32.

An alarm assembly by switch contact 90 and switch contact 92 that are connected by leads 94 to an alarm and battery pack 96. When no weight is placed on torsion bar 32 by the skier, switch contacts 90 and 92 do not touch and remain in the open condition. When a skier is using the harness to suspend himself, the added weight will cause rotating harness bar 32 to move in the downward direction as indicated by arrow 98 against the force caused by spring 91. At a certain point, contacts 90 and 92 will close completing an electrical circuit through leads 94 into the alarm and battery pack 96 thereby causing an alarm to sound. It may be noted that contact 92 may be adjusted to differing heights so that the alarm mechanism may be adjusted to the appropriate level. In this manner, a skier may be gradually weaned off using the harness device until he is completely on his own.

Also shown in FIG. 1I is a position locking rod that is inserted through the hollow suspension plate 86 and the rotating harness bar 32 through corresponding bores 102 and 104. In this manner, the rotating harness bar can be locked at a given position with respect to the ski slope in order to be used for teaching particular techniques. Such a mechanism can be used to prevent a nervous skier from inadvertently coming onto the engaging surface 54 without being positioned correctly.

Figure 1J:
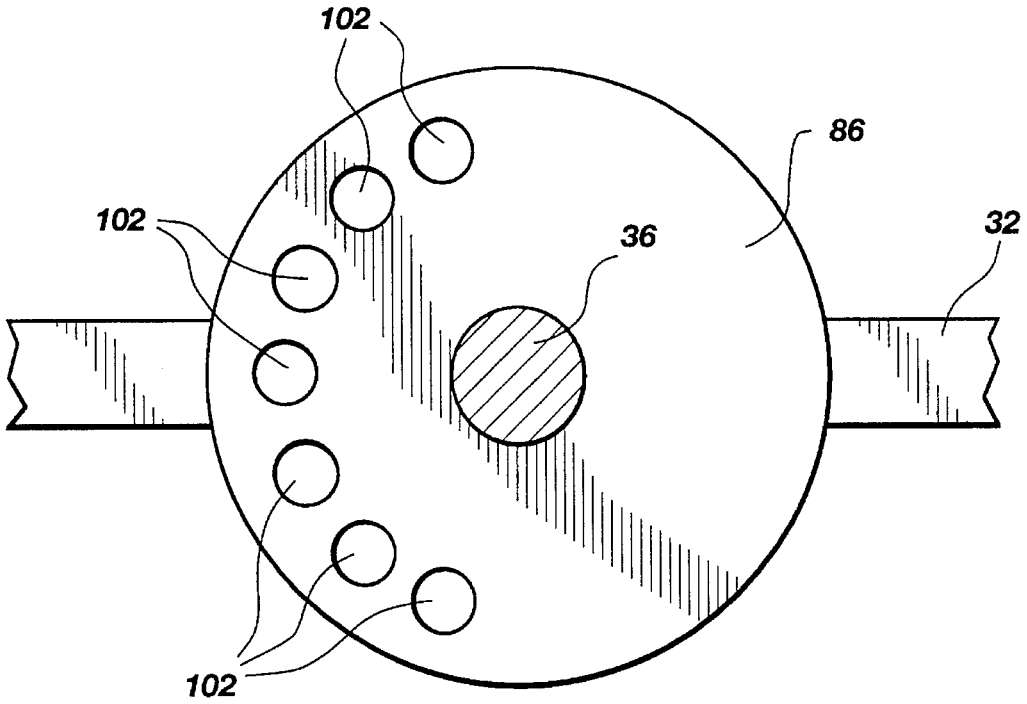
FIG. 1J is a top view of the hollow suspension plate of FIG. 1H with position locking holes shown in the plate.

This is best shown in FIG. 1J, which is an overhead view of FIG. 1I. A plurality of bores 102 correspond to the different orientations possible for rotating harness bar 32 (an hence the skier) and the fixed overhead support means (which also corresponds to the ground below). It may be noted that should the advanced harness configuration of FIG. 1F be used, then position locking rod 100 may extend through the bores 102 and either the rotating harness bar or the unweighting torsion bar 60. In any case, the fixed positioning is maintained.

Figure 2A:
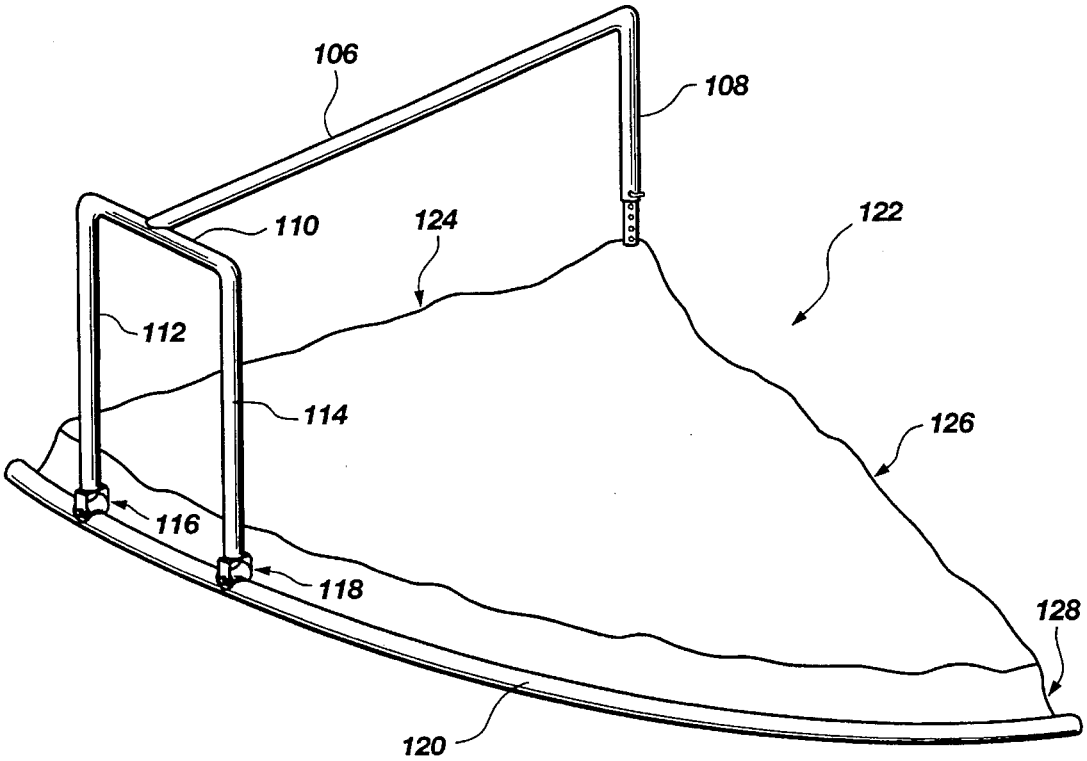
FIG. 2A is a front perspective of an embodiment of a ski skills training device with a variable slope and adjustable beam height and inclination.
Figure 2B:
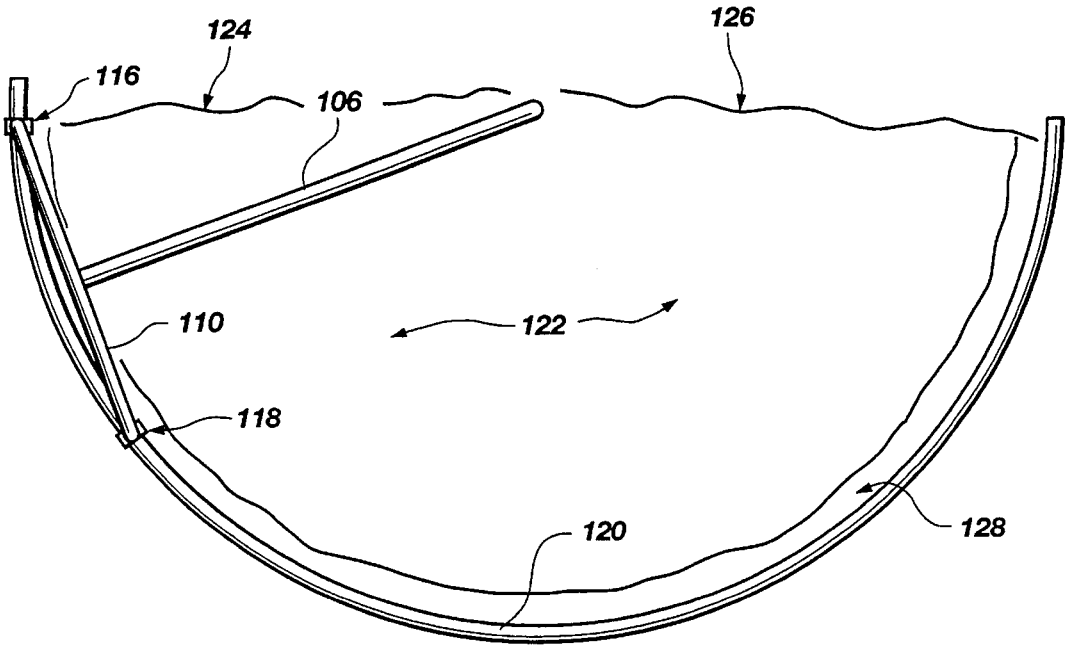
FIG. 2B is a top view of the embodiment shown in FIG. 2A.

Those skilled in the art will clearly notice that a number of FIGS. 2A and 2B show an alternate embodiment of a ski skills training device that is adjustable in nature. An overhead beam 106 is suspended by an adjustable post 108 and cross beam 110. Cross beam 110 is in turn supported by lower posts 112 and 114, each post having respective wheel assemblies 116 and 118. Wheel assemblies 116 and 118 may traverse track 120 to orient the overhead beam 106 at a desired location.

The overall slope of overhead beam 106 can be adjusted by adjustable post 108.

The terrain of the ski slope 122 varies from a relatively mild slope at 124 to a relatively steep slope at 126. The adjustable post 108 makes it possible to adjust the overhead beam 106 to correspond to the appropriate slope of the ski slope 122. Furthermore, a safety ditch 128 exists at the bottom of the ski slope 122.

FIGS. 2A and 2B show another configuration in providing an overhead support means for stabilizing a skier.

Figure 3A:
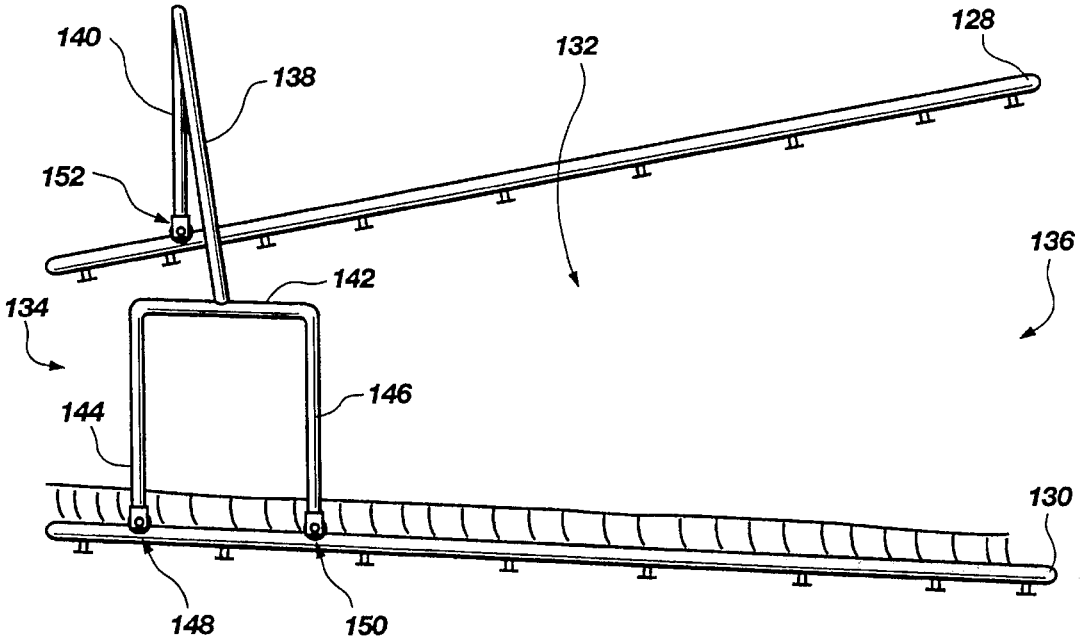
FIG. 3A is a perspective view of an embodiment of ski skills training device with a variable slope with two translation beams.
Figure 3B:
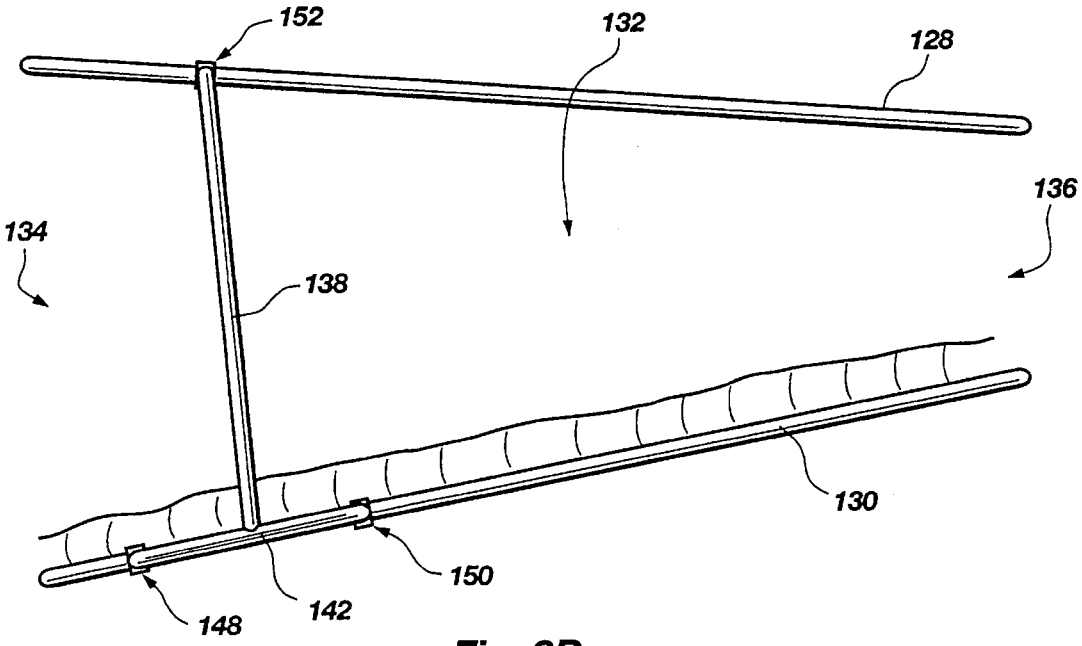
FIG. 3B is a top view of the embodiment shown in FIG. 3A.

FIGS. 3A and 3B show another embodiment for providing the overhead support beam that will allow the harness and roller carriage shown in FIG. 1A to be mounted thereon. FIG. 3A is a front view while FIG. 3B is a top view. Two translation tracks 128 and 130 are oriented in equal distance fashion upon a varying slope terrain 132. Terrain 132 has a relatively mild slope at 134 and a relatively steep slope at 136. An overhead beam 138 is suspended between an upper post 140 and a lower cross beam 142. The lower cross beam 142 is in turn supported by lower posts 144 and 146 respectively. Attached to the bottom of each lower post 144 and 146 is a corresponding wheel assembly 148 and 150. There is also a wheel assembly 152 associated with upper post 140. The wheel assemblies 148, 150 and 152 are used for moving and orienting the overhead beam 138 at a desired location across the sloping terrain 132. The overhead beam 138 may be easily rolled into position and locked into place for use.

Figure 4:
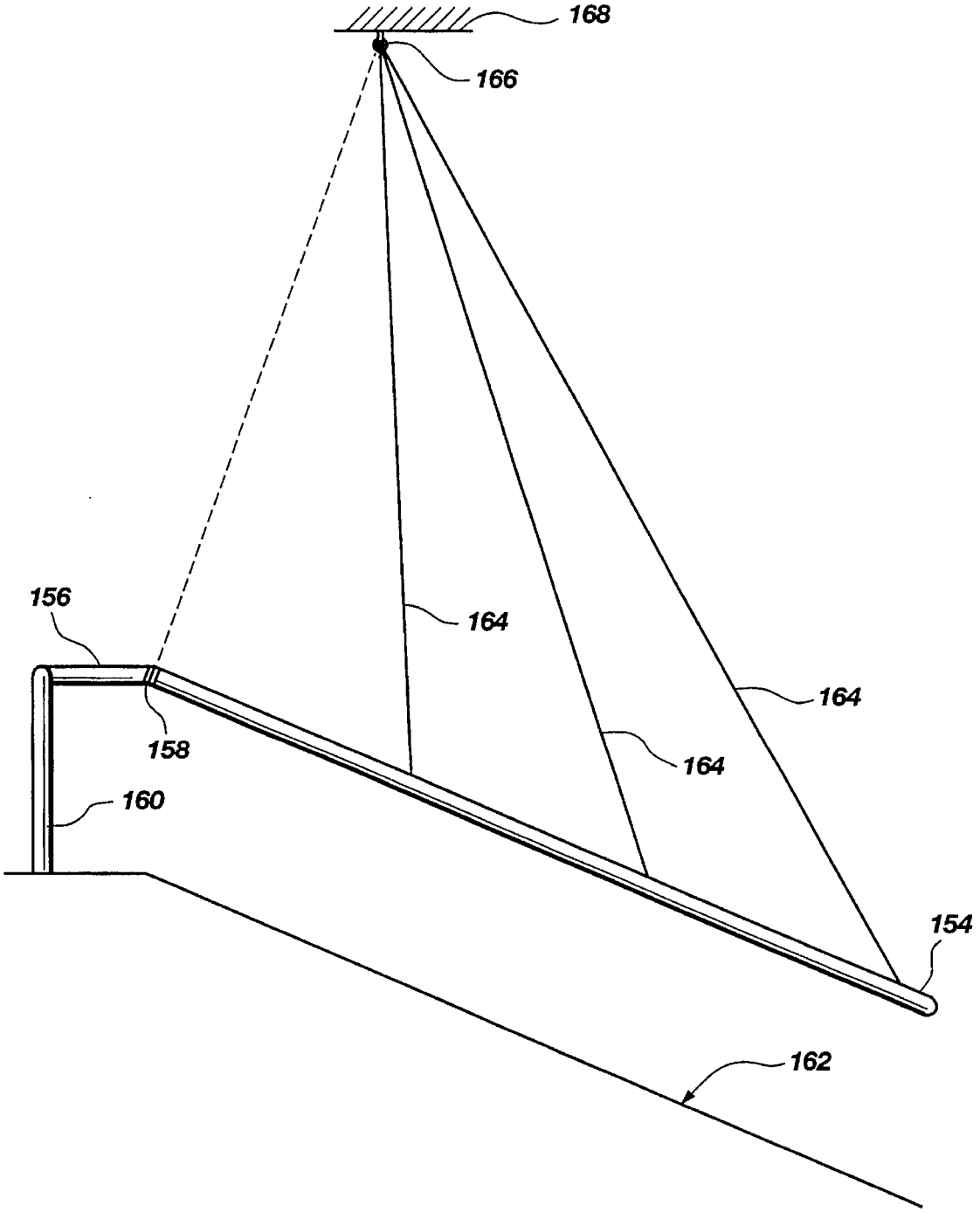
FIG. 4 is a side view of an embodiment of a ski skills training device which does not restrict the lateral motion of the skier but still supports the skiers weight. A light weight beam is supported by overhead cables.

FIG. 4 shows another embodiment of the ski skills training device according to the present invention that shows yet another way of orienting a overhead support beam as a supporting means for a skier. This embodiment is particularly effective for an indoor implementation. An overhead beam 154 is hingedly connected to a top beam 156 through hinge means 158. The top beam 156 is supported by upper post 160 that is mounted into the ski terrain. The ski surface 162 remains under the overhead beam 154 and the overhead beam 154 is suspended by a series of cable supports 164 that are attached to a cable fastener 166 in turn attached to a upper structure 168. This upper structure 168 could be the roof of a building or other structure tall enough to suspend the entire length of the overhead beam 154. Again, a skier would be suspended from this overhead beam 154 by means similar to the roller carriage and harness shown in FIG. 1A–1 E, the operation being the same.

Figure 5A:
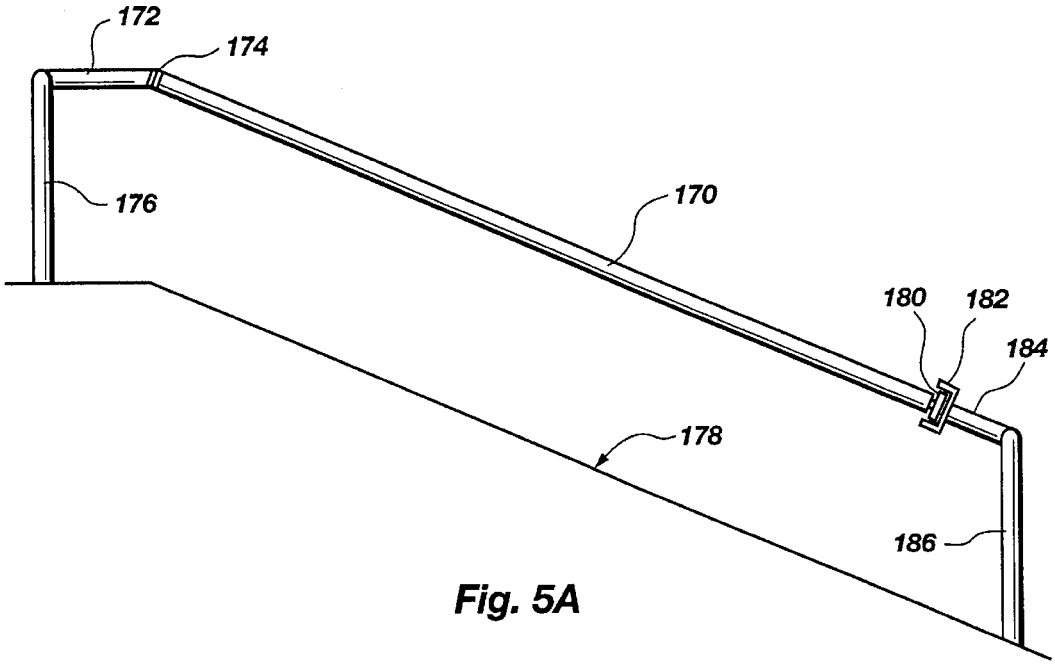
FIG. 5A is a side view of an embodiment of a ski skills training device where the bottom end of an overhead beam is supported by a roller which travels through a roller channel along an arch shape track.
Figure 5B:
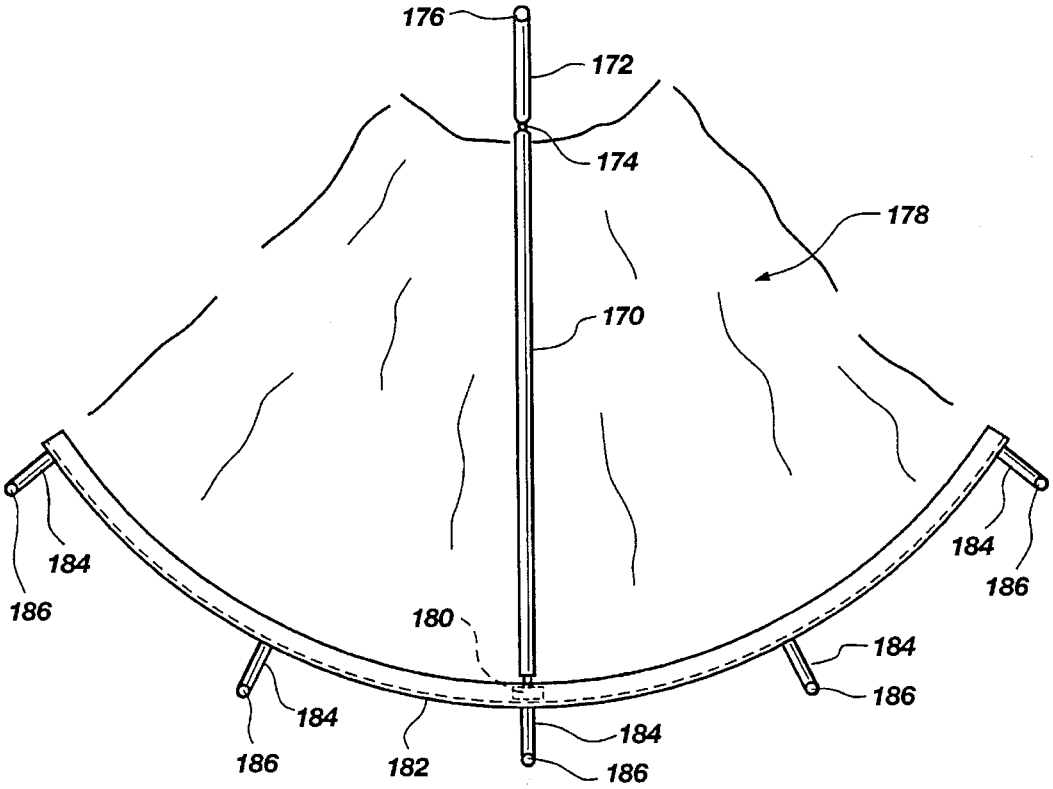
FIG. 5B is a top view of FIG. 5A.

Referring to FIG. 5A and 5B, another embodiment of suspending an overhead beam is shown. FIG. 5A is a side view with FIG. 5B being a top view of this embodiment.

Overhead beam 170 is suspended above the ski surface 178. On the top end, overhead beam 170 is hingedly connected to horizontal top beam 172 by hinge 174. Horizontal top beam 172 is in turn supported above the ski surface 178 by upper post 176. On the lower end, overhead beam 170 has a roller 180 that fits into and rolls along the surface of the arcuate track 182. The arcuate track 182 is suspended above the ground by a plurality of slope supports 184 resting atop corresponding lower posts 186.

Figure 6:
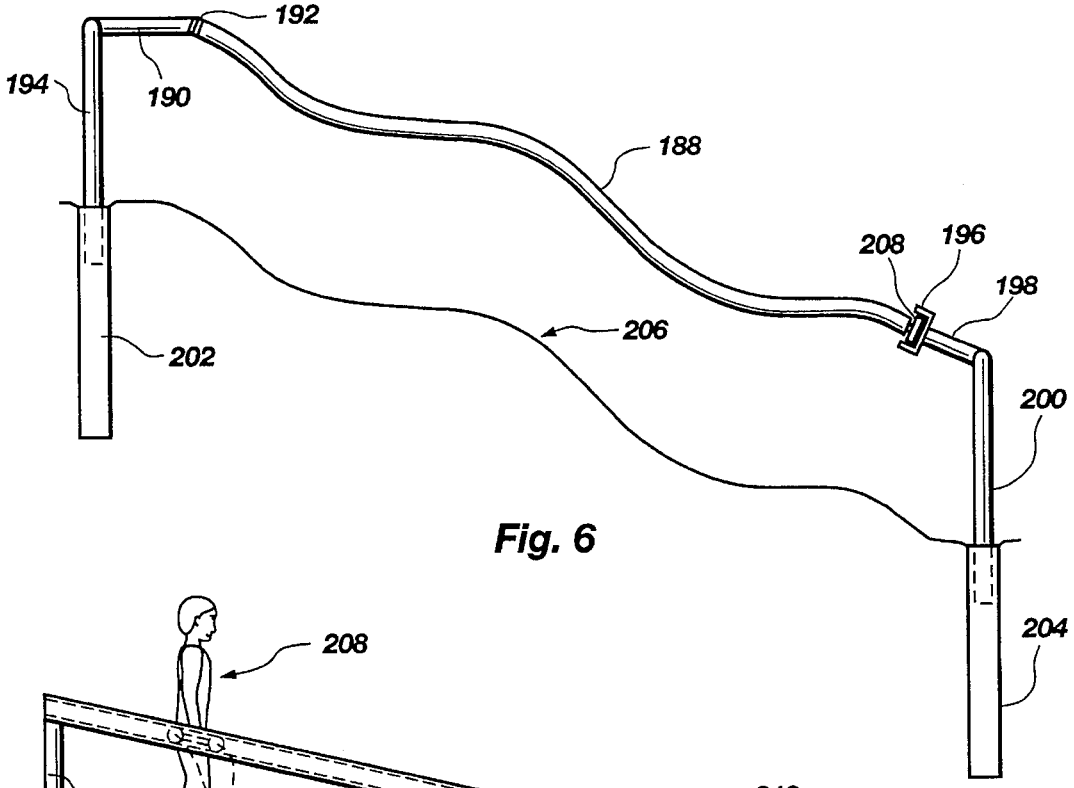
FIG. 6 is a side view of an embodiment similar to that shown in FIG. 5A where the overhead beam follows the contour of the terrain.

FIG. 6 shows an embodiment of a ski skills training device according to the present invention that is similar to the embodiment shown in FIGS. 5A and 5B. A shaped overhead beam 188 tracks the contour of a shaped ski surface 206 and is suspended on both ends in similar fashion to that shown in FIGS. 5A and 5B. On the top end, shaped overhead beam 188 is hingedly connected to horizontal top beam 190 by hinge 192. Horizontal top beam 190 is in turn rests atop upper moveable post 194 that rests within an upper post channel 202. The lower end of shaped overhead beam 188 has a roller 208 that fits within the arcuate channel 196 that is shaped in similar fashion as that of FIG. 5A and 5B. The arcuate channel 196 is supported by a plurality of sloped supports 198 that rests atop corresponding plurality of lower moveable posts fitting into a plurality of corresponding lower post channels 204.

This embodiment is particularly useful for learning ski skills related to moguls and other varied terrain. Furthermore, when the upper moveable post and the plurality of lower moveable posts 200 are lowered into their respective upper post channel 202 and plurality of lower post channels 204, the shaped overhead beam can be moved across a snow covered surface to actually shape the surface according to the shape of the beam. This provides a way of creating the actual moguls that will more perfectly correspond to the overhead beam 188.

Figure 7A:
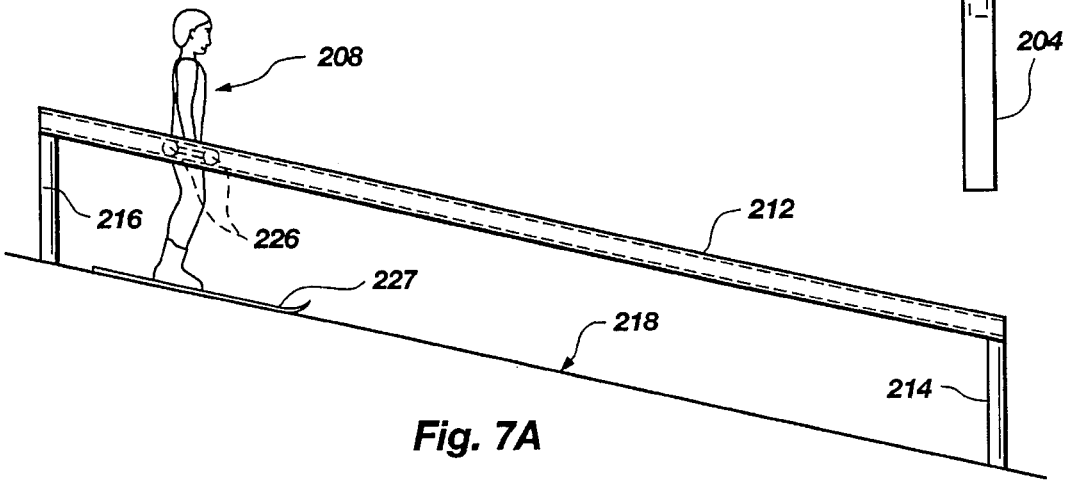
FIG. 7A is an embodiment of a ski skills training device utilizing side supports.
Figure 7B:
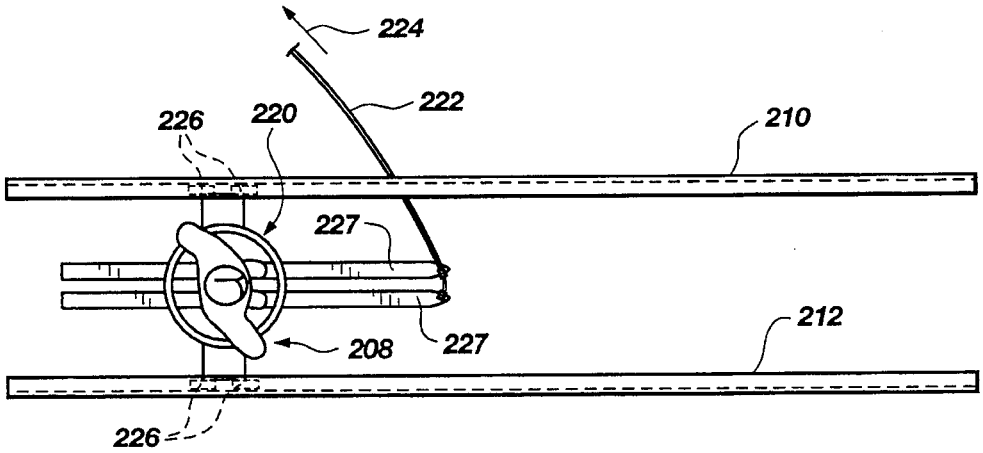
FIG. 7B is a top view of the embodiment shown in FIG. 7A.

FIGS. 7A and 7B show a different form of structural support means that can be used to support a skier while learning. In this embodiment, the skier 208 skis down the sloped ski surface 218 between two side channeled beams 210 and 212 respectively. The side channeled beams are supported by respective lower support posts 214 and upper support posts 216. The skier 208 is encompassed by a torsion brace assembly 220 that has a plurality of wheels 226 for engaging the channeled portion of the side channeled beams 210 and 212.

The skier 208 will use the torsion brace assembly 220 to assist himself in applying torque for turning the skis. As a further aid in helping the skier 208 turn their skis in the proper manner, a torque inducing pull rope 222 is attached to the skis 228. When the instructor pulls the torque inducing pull rope 222 in the direction of arrow 224, the skis 228 are thereby pulled into a desired location. In this manner, the skier 208 may be relieved of all effort in arriving at the proper ski positioning. This embodiment, is a further example of a skier structural support means that does not require an overhead beam.

Figure 8:
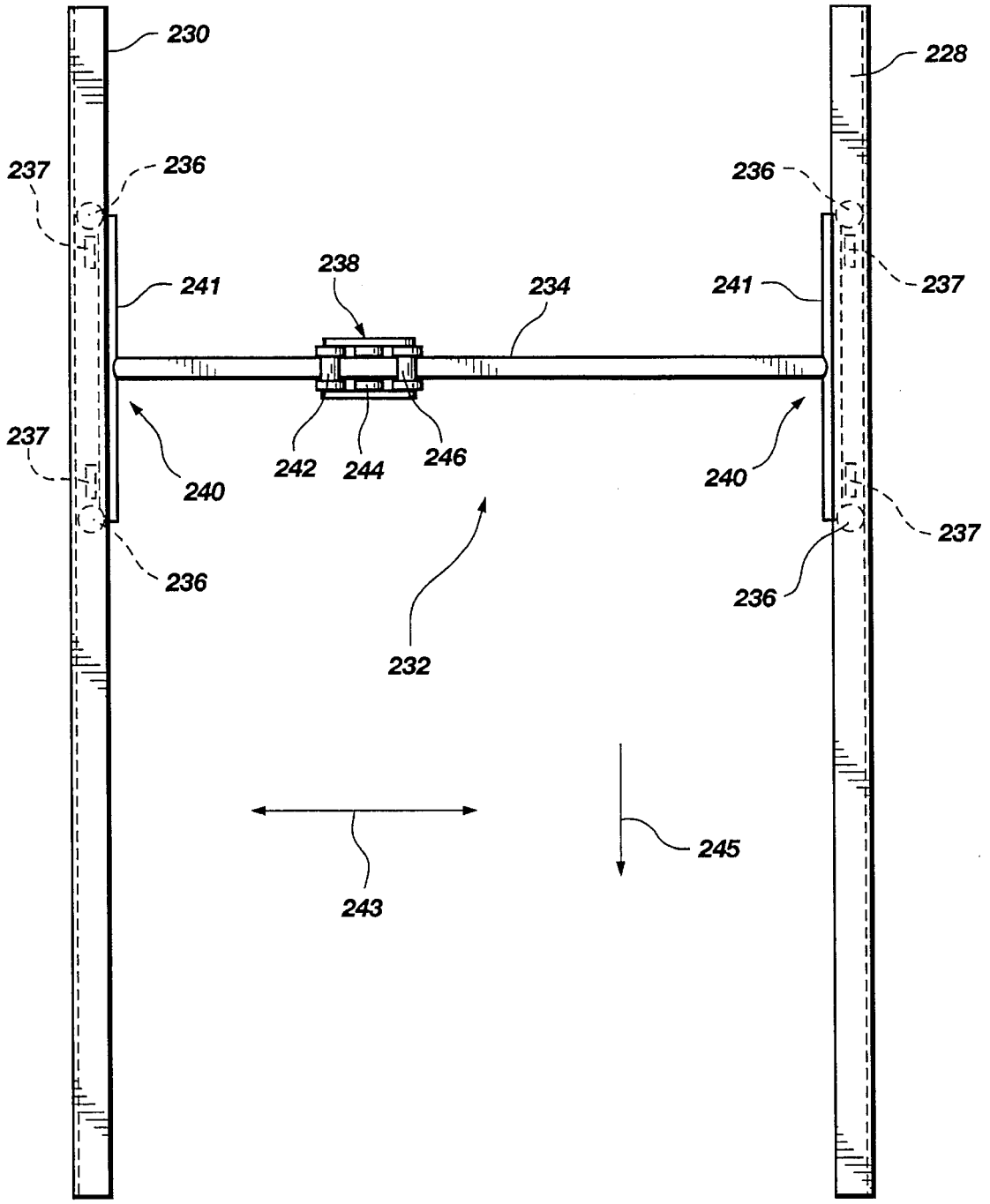
FIG. 8 is a top view of an embodiment of a ski skills training device in which a transverse beam travels on rollers on two overhead beams. The skier is suspended in a harness below the transverse beam.

FIG. 8 is a top view of an embodiment wherein two channeled overhead side beams 228 and 230 are suspended above a skiers head over a sloped surface (structural support means not shown). Resting between channeled overhead side beams 228 and 230 is an overhead cross beam assembly 232 comprised of an overhead cross beam 234 with rolling side assemblies on each side. Each rolling side assembly 240 has a plurality of wheels 236 for riding in the respective channel portion of the respectively channeled overhead side beams 228 and 230. Attached to the overhead cross beam 234 is a carriage assembly 238 which is similar to the roller carriage and associated rollers shown in FIG. 1A.

The skier is attached to the carriage assembly 238 and will have sideways mobility as shown by arrow 243 as well as downward mobility shown by arrow 245. This allows further training of a skier that better simulates actual slope conditions in terms of mobility for the skier.

In this embodiment of a ski skills training device the overhead side beams 228 and 230 are above the head of the skier. Carriage assembly 238 with rollers 242, 244 and 246 is the standard roller carriage which is used for suspending a harness. Carriage assembly 238 travels freely along the overhead cross beam 234. Overhead cross beam 234 is connected to two extensions for rollers 60. Weight carrying wheels 237 are connected to wheel extension 241 and roll along the inside of side beams 228 and 230. Anti-binding rollers 236 are positioned at the ends of channel overhead wheel extensions 241.

Figure 9:
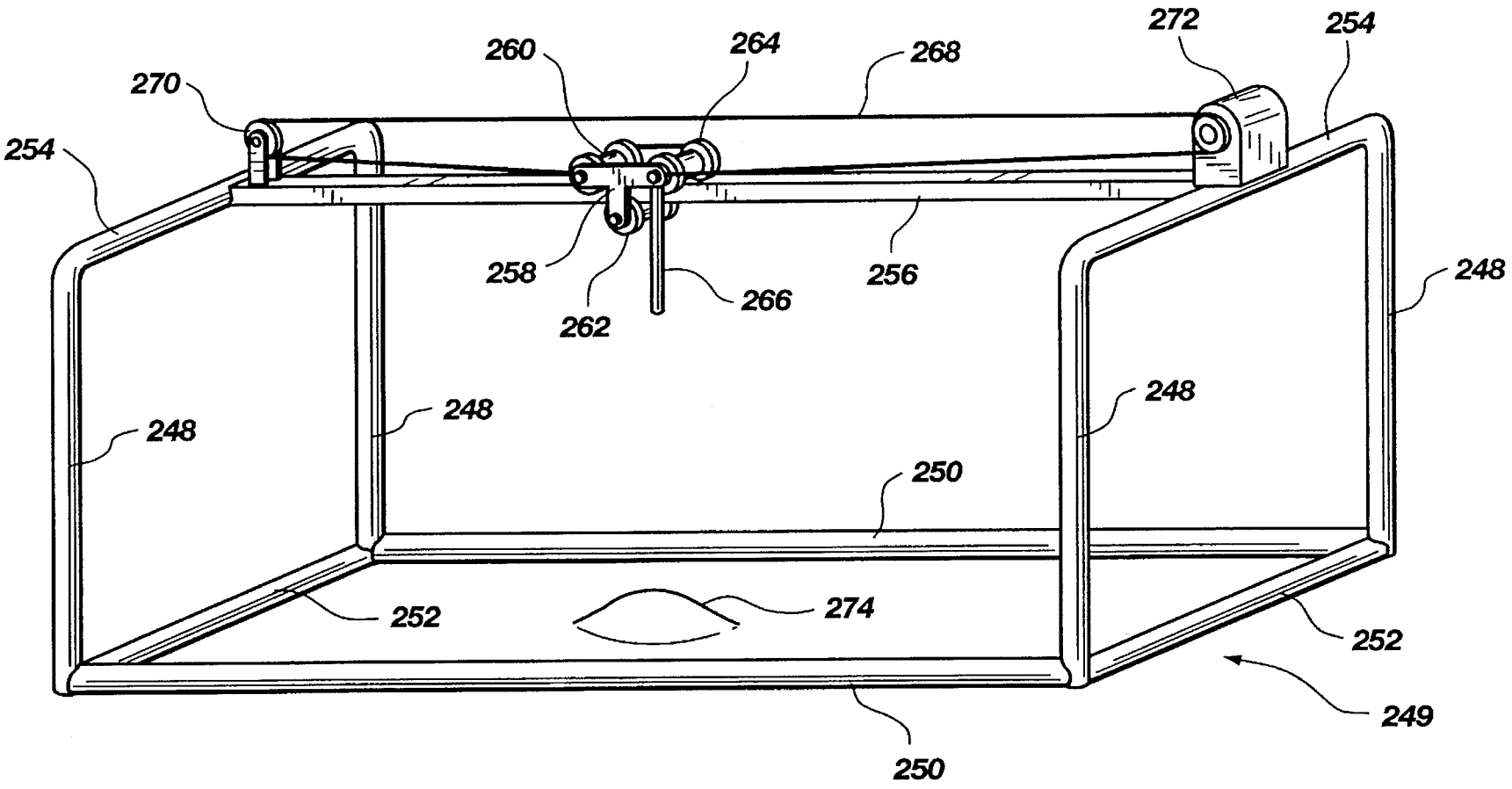
FIG. 9 is a perspective view of an embodiment of a ski skills training device which is portable. It can be used on a slope or can be used on a level surface with a motor providing acceleration to the skier in both directions.

In FIG. 9, a portable embodiment of a ski skills training device according to the present invention is shown that can be used for level as well as sloped surfaces. Because it is portable it may easily towed to a desired location having a desired slope by a snow cat. Four base support posts 248 extend upward from a lower rectangle structure 249 created by two lower length beams 250 connected to respective lower traverse beams 252. The lower rectangle structure 249 will actually groom the snow surface as it is pulled into position. A simple snowplowing component can be attached to any of these four beams to further groom the snow surface. Also, a leveling rod can be rested on any two base beams and dragged over the snow surface to periodically groom the surface between uses.

The four base support posts 248 support top traverse beams 254. Overhead beam 256 is connected between the two top traverse beams 254. A roller carriage 258, having rollers 260, 262, and 264 along with a torsion bar 266 as better explained in connection with the embodiment of FIGS. 1 A–1E previously attached to the overhead beam 256. The roller carriage is pulled between retrieval pulley 270 and motor assembly 272 by means of a movement cable 268. An unweighting bump 274 can be added and removed depending on the technique which is currently being practiced.

This embodiment allows the flexibility of training on a level ski surface since the motor assembly 272 can be used to provide the velocity needed by the skier to learn techniques requiring the sideways sliding of the skis.

The slide slip that requires the skis to be slid sideways in the snow can easily be taught on any embodiment of a ski skills training device which has an adjustable slope capability as shown in FIGS. 2A, 2B, 3A, 3B, 5A, 5B and 6. The invention is adjusted to the steeper slope and the skier is started at a point where his skis are in contact with the snow. He points the skis slightly downhill and releases pressure on the uphill edge. A hand held brake hand grip to operate a braking mechanism as shown in FIG. 1G can be used to provide an added sense of security during the first few attempts.

The embodiments of the invention as shown in FIGS. 4, 5A, 5B, 6, and 8 which allows the skier to traverse left to right as he travels down the length a suspended overhead beam permits christy and parallel turns. Again a hand held brake hand grip to control a braking mechanism can provide an added sense of security.

In all of the prior art the overhead suspension beam or cable never was designed to follow a mogul covered surface. The embodiment containing a waved overhead beam which conforms to bumps and jumps on the snow surface as shown in FIG. 6 aids the skier in learning mogul top and aerial turning.

FIG. 9 shows the configuration of the ski skills training device which is portable. The steepness of the overhead beam 256 can easily be adjusted by towing the device by a snow cat to a steeper slope. The towing process is self grooming in that the surface is flattened as the device is dragged into position.

The snow directly under the starting point will need to be dug out to suspend the skier or the harness device which lowers the skier on to the snow will need to be implemented. On sloped terrain this configuration of the ski skills training device is operated like in previous configurations. On more level terrain the acceleration is accomplished by a motor or by having an instructor push or pull the skier. A small unweighting bump 274 can be added directly under overhead beam 256 and removed depending on which technique is currently being taught. Unweighting bump 274 allows the skier to lessen the weighting of his skis and more easily pivot them.

Skier progress on any configuration of the ski skill training device can be monitored by attaching a gauge to pulley for retrieval line. From this gauge the maximum speed and stopping distances for each attempt can be determined and new goals can be set for the skier.

With long overhead beams which can be adjusted to steeper inclines the skier can quickly gain confidence in his ability to generate stopping power at much higher speeds. The adjustable incline capability creates the equivalent of intermediate and advanced ski slopes. Also the convenient retrieving line can be used to start the skier from various points along the overhead beam thereby making it possible to control his speed at the end of the run. Essentially, a first time skier can acquire several valuable advanced techniques before ever stepping on to a ski slope.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method for teaching skiing skills requiring sliding the skis sideways such as the hockey stop, parallel turn, skidding at various angles and others to skiers equipped with skis comprising the steps of:

supporting the skier in a means for harnessing that is pivotally and slidingly engaged to a support structure, the support structure running a distance along a ski surface sufficient for teaching a desired ski skill;

accelerating the skier to a sufficient speed for teaching the desired ski skill;

pivoting the skier so that the length of the skis are non-parallel to the direction of travel along the ski surface causing the skier to slide the skis sideways in a manner required by the desired ski skill thereby training the skier in that skill within the safe and guided confines of the means for harnessing and support structure and in a way that the skier experiences the feel of the technique without fear and learns the muscle coordination skills associated with the technique.

2. A method for teaching skiing skills as recited in claim 1 wherein pivoting is achieved by a bar held between the skier and an instructor.

3. A method for teaching skiing skills as recited in claim 1 further comprising the step of returning the skier to an initial position after traveling over the ski surface.

4. A method for teaching skiing skills as recited in claim 1 further comprising the step of notifying the skier whether the support means has been used during the practice of the technique.

5. A method for teaching skiing skills as recited in claim 1 further comprising the step of initially suspending the skier so that the skis initially have no contact with the ski surface and later have contact with the ski surface during or after acceleration.

6. A method for teaching skiing skills as recited in claim 1 wherein the pivoting step fixedly pivots the skier so that the skier will always be in a position where the skis will slide at some angle to the direction of travel over the ski surface.

7. A method for teaching skiing skills as recited in claim 1 wherein the pivoting is achieved by pulling a torque inducing pull cord that is attached to the skis.

8. A method for teaching skiing skills as recited in claim 1 wherein the pivoting is achieved by an instructor manually twisting the skier at the desired time.

9. A method for teaching skiing skills as recited in claim 1 wherein the pivoting is achieved by the skier pushing or pulling a downward extending torsion bar that is fixedly attached to a carriage that is slidingly engaged with the support structure, the harnessing means being pivotally coupled with the carriage.

10. A method for teaching skiing skills as recited in claim 1 wherein the harnessing means comprises:

a rotating harness bar having two ends, the bar oriented above the skier and the ends extending outward on each side of the skier; and a pair of unweighting straps extending downward from each end of the rotating harness bar and within reach of the skier, each strap having unweighting hand grips attached to the end thereof;

and the pivoting is achieved by the skier pushing into or pulling on the unweighting hand grips to unweight the skis in order to pivot the skis into the desired position.

11. A method for teaching skiing skills as recited in claim 1 wherein the harnessing means is pivotally coupled with a carriage slidingly engaged to the support structure, the carriage comprising:

an unweighting torsion bar having two ends fixedly coupled to the carriage, the bar oriented above the skier and the ends extending outward on each side of the skier; and a pair of torsion and unweighting straps extending downward from each end of the unweighting torsion bar and within reach of the skier, each strap having torsion and unweighting hand grips attached to the end thereof;

and the pivoting is achieved by the skier pushing into or pulling on the torsion and unweighting hand grips to unweight the skis and to twist the unweighting torsion bar in order to pivot the skis into the desired position.

12. A method for teaching skiing skills requiring sliding the skis sideways such as the hockey stop, parallel turn, skidding at various angles and others to skiers equipped with skis comprising the steps of:

supporting the skier in a means for harnessing that is pivotally and slidingly engaged to an overhead beam, the overhead beam running a distance along a ski surface sufficient for teaching a desired ski skill;

accelerating the skier to a sufficient speed for teaching the desired ski skill;

pivoting the skier so that the length of the skis are non-parallel to the direction of travel over the ski surface causing the skier to slide the skis sideways in a manner required by the desired ski skill thereby training the skier in that skill within the safe and guided confines of the means for harnessing and overhead beam and in a way that the skier experiences the feel of the technique without fear and learns the muscle coordination skills associated with the technique.

13. A ski skills training device for supporting a skier equipped with skis during the learning of skiing techniques as the skier travels on a ski surface, the device comprising:

a structural support means running about a ski surface;

a means for supporting the skier pivotally and slidingly engaged to the structural support means so that a skier may traverse a length of the ski surface while being safely supported with respect to the support means; and selectable means for pivoting the skier with respect to the structural support means to orient the skier so that the skis are in a desired position with respect to the ski surface for teaching ski techniques.

14. A ski skills training device as recited in claim 13 further comprising means for braking or stopping the sliding movement of the means for supporting the skier.

15. A ski skills training device as recited in claim 13 wherein the selectable means for pivoting the skier comprises a torque inducing pull rope that is attached to the skis of the skier.

16. A ski skills training device as recited in claim 13 wherein the means for supporting the skier comprises:

a carriage slidingly engaged to the structural support means; and a harness means pivotally coupled with the carriage;

and the selectable means for pivoting the skier comprises a torsion bar extending downward from the carriage and within reach of the harnessed skier for allowing the skier to pivot himself with respect to the carriage.

17. A ski skills training device as recited in claim 13 wherein the means for supporting the skier comprises:

a carriage slidingly engaged to the structural support means; and a harness means pivotally coupled to the carriage, the harness means comprising:

a rotating harness bar having two ends, the bar oriented above the skier and the ends extending outward on each side of the skier; and a pair of unweighting straps extending downward from each end of the rotating harness bar and within reach of the skier, each strap having unweighting hand grips attached to the end thereof;

and the selectable means for pivoting the skier comprises the skier pushing into or pulling on the unweighting hand grips to unweight the skis in order to pivot the skis into the desired position.

18. A ski skills training device as recited in claim 13 wherein the means for supporting the skier comprises:

a carriage slidingly engaged to the structural support means;

a harness means pivotally coupled to the carriage;

an unweighting torsion bar having two ends fixedly coupled to the carriage, the bar oriented above the skier and the ends extending outward on each side of the skier; and a pair of torsion and unweighting straps extending downward from each end of the unweighting torsion bar and within reach of the skier, each strap having torsion and unweighting hand grips attached to the end thereof;

and the selectable means for pivoting the skier comprises the skier pushing into or pulling on the torsion and unweighting hand grips to unweight the skis and to twist the unweighting torsion bar in order to pivot the skis into the desired position.

19. A ski skills training device as recited in claim 13 wherein the means for supporting the skier comprises:

a carriage slidingly engaged to the structural support means;

a harness means pivotally coupled to the carriage, the harness means comprising:

a rotating harness bar having two ends, the bar oriented above the skier and the ends extending outward on each side of the skier; and a pair of unweighting straps extending downward from each end of the rotating harness bar and within reach of the skier, each strap having unweighting hand grips attached to the end thereof:

an unweighting torsion bar having two ends fixedly coupled to the carriage, the bar oriented above the skier and the ends extending outward on each side of the skier; and a pair of torsion and unweighting straps extending downward from each end of the unweighting torsion bar and within reach of the skier, each strap having torsion and unweighting hand grips attached to the end thereof:

and the selectable means for pivoting the skier comprises the skier pushing into or pulling on the unweighting hand grips to unweight the skis in order to pivot the skis into the desired position or pushing into or pulling on the torsion and unweighting hand grips to unweight the skis and to twist the unweighting torsion bar in order to pivot the skis into the desired position.

20. A ski skills training device as recited in claim 13 wherein the selectable means for pivoting the skier is actuable by an instructor.

21. A ski skills training device as recited in claim 13 wherein the selectable means for pivoting the skier is actuable by the skier.

22. A ski skills training device as recited in claim 13 wherein the selectable means for pivoting the skier is actuable by a computer controlled means.

23. A ski skills training device as recited in claim 13 further comprising means for rapidly returning the skier to an initial position for quickly repeating the training process.

24. A ski skills training device as recited in claim 13 further comprising means for rapidly returning the skier to an initial position for quickly repeating the training process and a means for raising the skier completely off the ski surface before returning the skier to an initial position.

25. A ski skills training device as recited in claim 13 further comprising means for signaling if the skier places any weight on the harnessing means.

26. A ski skills training device as recited in claim 13 wherein the support structure is an overhead beam that tracks the contour of the ski surface.

27. A ski skills training device as recited in claim 13 wherein the ski surface has a varied sloped and the ski skills training device further comprises means for adjusting the support structure to the varying slope of the ski surface.

28. A ski skills training device for supporting and guiding a skier during the learning of skiing techniques as the skier travels down a snow-covered slope, the device comprising:

an overhead support beam disposed above the skier's head and running from a higher position to a lower position along the snow-covered slope;

a harness means for supporting the skier, the harness means pivotally and slidingly engaged to the overhead support beam so that a skier may traverse the snow-covered slope from the higher position to the lower position while being safely supported by the harness means and guided by the overhead support beam; and selectable means for pivoting the harness means with respect to the overhead support beam for orienting the skier so that the skis are in a desired position with respect to the snow-covered slope for teaching ski techniques.

* * * * *